US005321932A

United States Patent [19]

Sundberg

[11] Patent Number: 5,321,932

[45] Date of Patent: Jun. 21, 1994

[54] CAPSULE HANDLING SYSTEM

[75] Inventor: James A. Sundberg, Apple Valley, Calif.

[73] Assignee: Professional Compounding Centers of America, Inc., Houston, Tex.

[21] Appl. No.: 841,475

[22] Filed: Feb. 26, 1992

[51] Int. Cl.[5] ..... B65B 43/40

[52] U.S. Cl. ..... 53/468; 53/281; 53/381.4; 53/390; 53/471; 53/900

[58] Field of Search ..... 53/900, 390, 468, 471, 53/489, 281, 299, 284.5, 381.4, 168; 206/534, 828

[56] References Cited

U.S. PATENT DOCUMENTS

| | | | |
|---|---|---|---|
| 326,578 | 9/1885 | Merz . | |
| 422,365 | 3/1890 | Bateson . | |
| 803,145 | 10/1905 | Winchester . | |
| 899,761 | 9/1908 | Remington . | |
| 1,092,319 | 4/1914 | Winchester | 53/390 |
| 1,155,023 | 9/1915 | Winchester . | |
| 1,567,639 | 12/1925 | Eastman | 53/390 |
| 1,667,066 | 4/1928 | Brown | 53/390 |
| 1,839,820 | 1/1932 | Wilkie | 53/900 X |
| 1,993,716 | 3/1935 | Hanley et al. . | |
| 2,322,169 | 6/1943 | Smith . | |
| 2,348,749 | 5/1944 | Norelli . | |
| 2,742,749 | 4/1956 | McGuire . | |
| 3,078,629 | 2/1963 | Besemer et al. | 53/471 |
| 3,286,436 | 11/1966 | Lakso . | |
| 3,518,340 | 6/1970 | Raper | 53/900 X |
| 3,552,095 | 1/1971 | Inman . | |
| 3,675,390 | 7/1972 | Austin | 53/900 X |
| 3,978,640 | 9/1976 | Crossley et al. | 53/900 X |
| 4,089,152 | 5/1978 | Zanasi . | |
| 4,163,354 | 8/1979 | Austin | 53/468 X |
| 5,081,822 | 1/1992 | Boyd et al. | 53/900 X |

FOREIGN PATENT DOCUMENTS

| | | | |
|---|---|---|---|
| 2177074 | 1/1987 | United Kingdom | 53/900 |

*Primary Examiner*—John Sipos
*Assistant Examiner*—Daniel Moon
*Attorney, Agent, or Firm*—Dickstein, Shapiro & Morin

[57] ABSTRACT

A capsule handling system is formed of a loader component and an opener/encapsulater component. The system can handle different sized capsules, and has interchangeable parts so that a compounding pharmacist can conveniently produce a variety of distinct filled capsules, on the order of a prescribing medical professional to meet the unique needs of patients.

17 Claims, 7 Drawing Sheets

CAPSULE HANDLING SYSTEM

BACKGROUND OF THE INVENTION

1. Field of the Invention

The present invention relates to a system for handling capsules, such as gelatin capsules. More particularly, the present invention relates to a system for conveniently opening empty capsules, filling the capsules with medicine or the like, and then re-closing the capsules.

2. Description of Related Art

Prior art capsule handling systems U.S. Pat. No. 326,578 (Merz), U.S. Pat. No. 422,365 (Bateson), U.S. Pat. No. 803,145 (Winchester), U.S. Pat. No. 899,761 (Remington), U.S. Pat. No. 1,155,023 (Winchester), U.S. Pat. No. 1,993,716 (Hanley et al.), U.S. Pat. No. 2,322,169 (Smith), U.S. Pat. No. 2,348,749 (Norelli), U.S. Pat. No. 2,742,749 (McGuire), U.S. Pat. No. 3,286,436 (Lakso), U.S. Pat. No. 3,552,095 (Inman) and U.S. Pat. No. 4,089,152 (Zanasi). Also, there is a known capsule handling system marketed by a company called Feton ®.

SUMMARY OF THE INVENTION

An object of the present invention is to provide a relatively inexpensive system for handling different sized capsules.

Another object of the invention is to provide capsule handling systems that have interchangeable parts so that a compounding pharmacist can conveniently produce a variety of distinct filled capsules, on the order of a prescribing medical professional to meet the unique needs of patients. Being able to distinguish filled capsules from each other is an important safety consideration. With the present invention, the pharmacist has the ability to make one hundred distinct, different-looking filled capsules while only purchasing ten different types of empty capsules from a manufacturer.

Another object of the invention is to provide a capsule handling system that is uncomplicated and reliable.

Accordingly, the present invention relates to a system formed of a loader component and an opener/encapsulater component, with the loader component being used to simultaneously position and orient different sized capsules within the opener/encapsulater component.

The present invention also relates to a capsule handling system formed of: (1) an opener/encapsulater component for opening, filling and closing capsules; and (2) a loader component for positioning and orienting the capsules within the opener/encapsulater component; wherein the opener/encapsulater component has a pair of capsule receiving plates, each with a plurality of holes for receiving the capsules. Advantageously, at least one of the plates can be displaced to hold the bottom portions of the capsules. Another advantage of the present invention is that the plates can be removed and replaced by plates with different sized holes for handling different sized capsules.

The present invention also relates to a method including the steps of: using a loader component to position and orient capsules within an opener/encapsulater component; using the opener/encapsulater component to separate the top portions of the capsules from their bottom portions; using a second opener/encapsulater component to separate the top and bottom portions of second capsules; filling the bottom portions of the first capsules; and connecting the bottom portions of the first capsules to the top portions of the second capsules.

With the present invention, an operator can open a large number of capsules at the same time, simultaneously fill the bottom portions of the capsules, and then replace the top portions of the capsules onto their respective bottom portions.

A preferred embodiment of the invention is formed of two modular components: (1) an opener/encapsulater component; and (2) a loader component for loading capsules into the opener/encapsulater component such that all of the capsules are oriented in the same direction (bottom portions down). The loader component has two parallel plates, each with matching elongated slots. The plates are removably held within the loader component by a slidable retainer.

In operation, the loader component is supported on the opener/encapsulater component, and the capsules are positioned within the slots of the top plate, without regard to the orientation of the capsules. Initially, the capsules do not fall through the bottom plate because the slots of the bottom plate are not directly underneath the slots of the top plate. But then the top plate is pushed against the horizontally directed spring such that the top plate slots are located over the slots of the bottom plate. The capsules then fall through the bottom plate slots and into the opener/encapsulater component. In doing so, the top portions of the capsules are caught by the edges of the slots of the bottom plate, such that all the capsules fall into the opener/encapsulater component in the same direction, i.e., bottom portions first.

Advantageously, the retainer can be moved down and the plates can be removed and replaced by plates with slots sized for different sized capsules. Another important feature of the invention is that the plates of the loader component are machined, not stamped and die cut out of aluminum, as is the case with the known machine manufactured by Feton. The machined plates of the present invention more accurately flip (turn) the capsules. Machining the plates also improves interchangeability between two systems.

The opener/encapsulater component has a pair of receiver plates with matching holes for receiving the bottom portions of the capsules as they fall from the loader component. The capsule bottom portions are firmly held (pinched) within these plates by slightly displacing one of the plates with respect to the other. All of the top portions of the capsules are then removed from their respective bottom portions by lifting a support plate assembly off of the opener/encapsulater component. The top portions are held within the assembly by a removable keeper plate. The bottom portions are then filled with medicine or the like, and then the capsule top portions are placed back onto the bottom portions by replacing the assembly onto the housing of the opener/encapsulater component. To firmly re-connect the portions of the capsules, the holes of the receiver plates are realigned and the capsule bottoms are pushed upwardly by a movable push plate, whose lowermost position is selectively adjustable.

Like the plates of the loader, the receiver plates and the support plate of the opener/encapsulater component can be removed and replaced by plates with different sized holes. In this way, the capsule handling system can handle a variety of different sized capsules. Also, the receiver plates are machined. Since all of the plates of the preferred embodiment are machined, two capsule handling systems can be used together to produce a wide variety of distinct, filled capsules.

Other objects and features of the present invention will be apparent from the following detailed description and drawings which illustrate preferred embodiments of the invention.

DETAILED DESCRIPTION OF PREFERRED EMBODIMENTS

Figure 1:
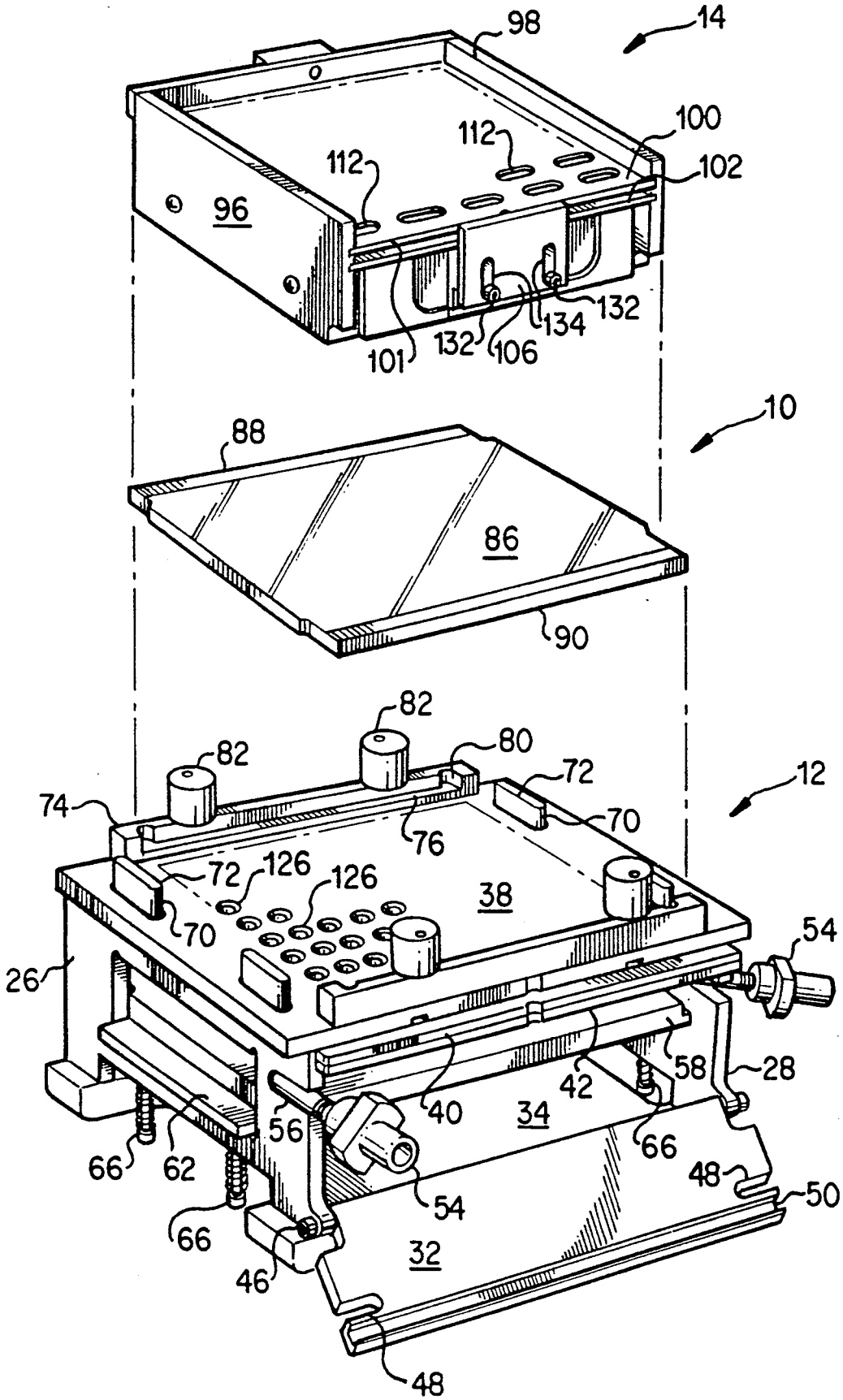
FIG. 1 is an exploded, perspective view of a capsule handling system in accordance with the present invention.

Referring now to the drawings, wherein like reference numerals indicate like elements, there is shown in FIG. 1 a capsule handling system constructed in accordance with the principles of the present invention and designated generally by reference numeral 10. The capsule handling system 10 is formed generally of an opener/encapsulater component 12 and a loader component 14.

Figure 10:
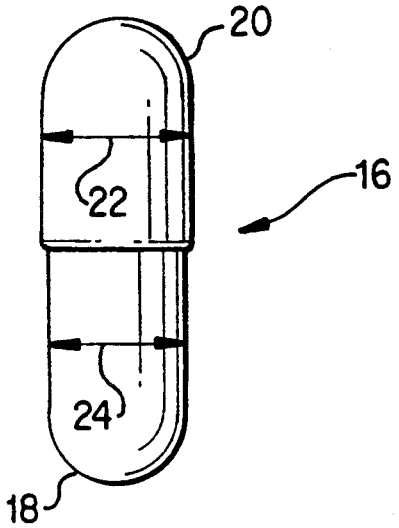
FIG. 10 is a side view of a capsule.

The capsule handling system 10 is designed to handle up to one hundred conventional gelatin capsules 16, one of which is shown in FIG. 10. Each gelatin capsule 16 has a bottom portion 18 fitted into a top portion 20 with a friction fit. The diameter 22 of the top portion 20 is slightly greater than the diameter 24 of the bottom portion 18. Preferably, the capsule handling system 10 will accurately fill capsules 16 in sizes 00, 0, 1 and 3.

The opener/encapsulater component 12 (FIG. 2) has a housing formed of side walls 26, 28, a back wall 30 (FIG. 4), a door 32, and a bottom 34 (FIG. 5) supported on legs 36. Preferably, the walls 26, 28 and 30, and the door 32 are formed of lightweight aluminum, the bottom 34 is formed of plastic and the legs 36 are formed of an elastomeric material.

A support plate 38 (FIG. 2) is located on top of the walls 26, 28 and 30, and receiving plates 40, 42 are slidably received within the housing, underneath the support plate 38. Preferably, the plates 40, 42 are slidably supported on ledges 44 machined into each wall 26, 28.

Figure 4:
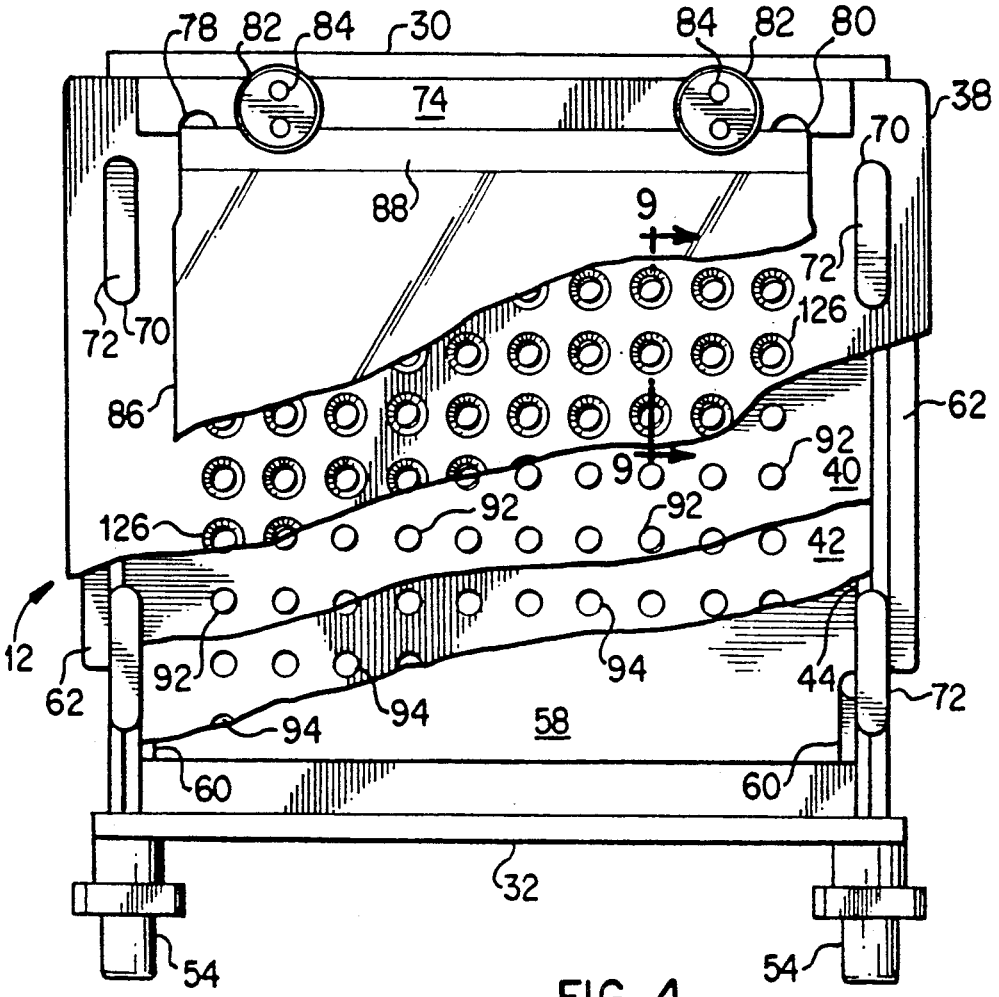
FIG. 4 is a partially cut away top view of the opener-/encapsulater component of FIG. 2.
Figure 5:
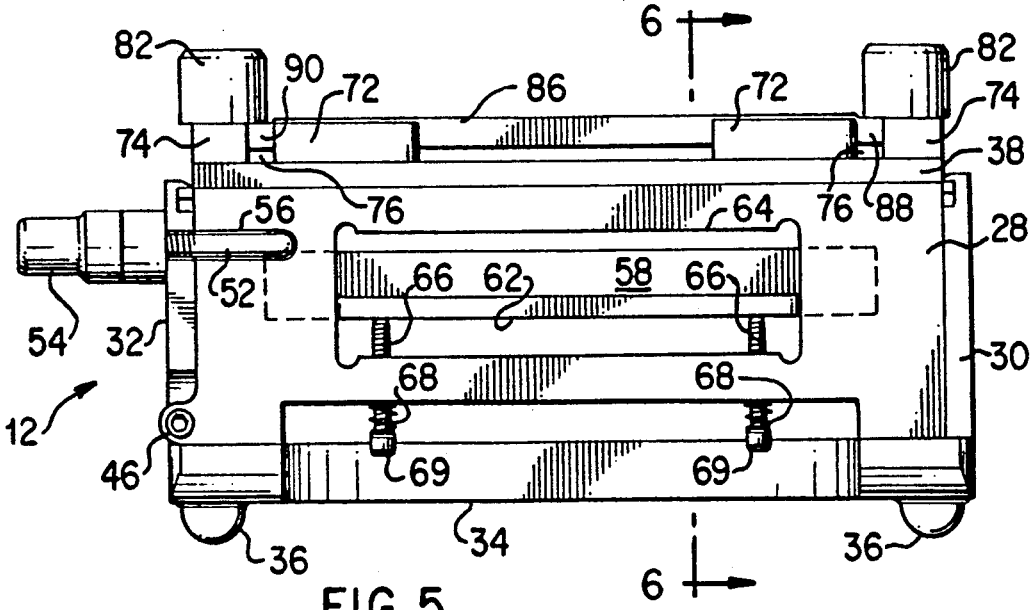
FIG. 5 is a side view of the opener/encapsulater component of FIG. 2.

The door 32 is hinged to the walls 26, 28 by a pin type hinge 46. The door 32 has connecting slots 48 at its top side corners. The door 32 is shown in its open position in FIG. 2. The door 32 is vertical in its closed position (FIGS. 4 and 5). When the door 32 is in its closed position, a grooved bearing means 50 (FIG. 6) pushes against the front edges of the plates 40, 42.

Figure 2:
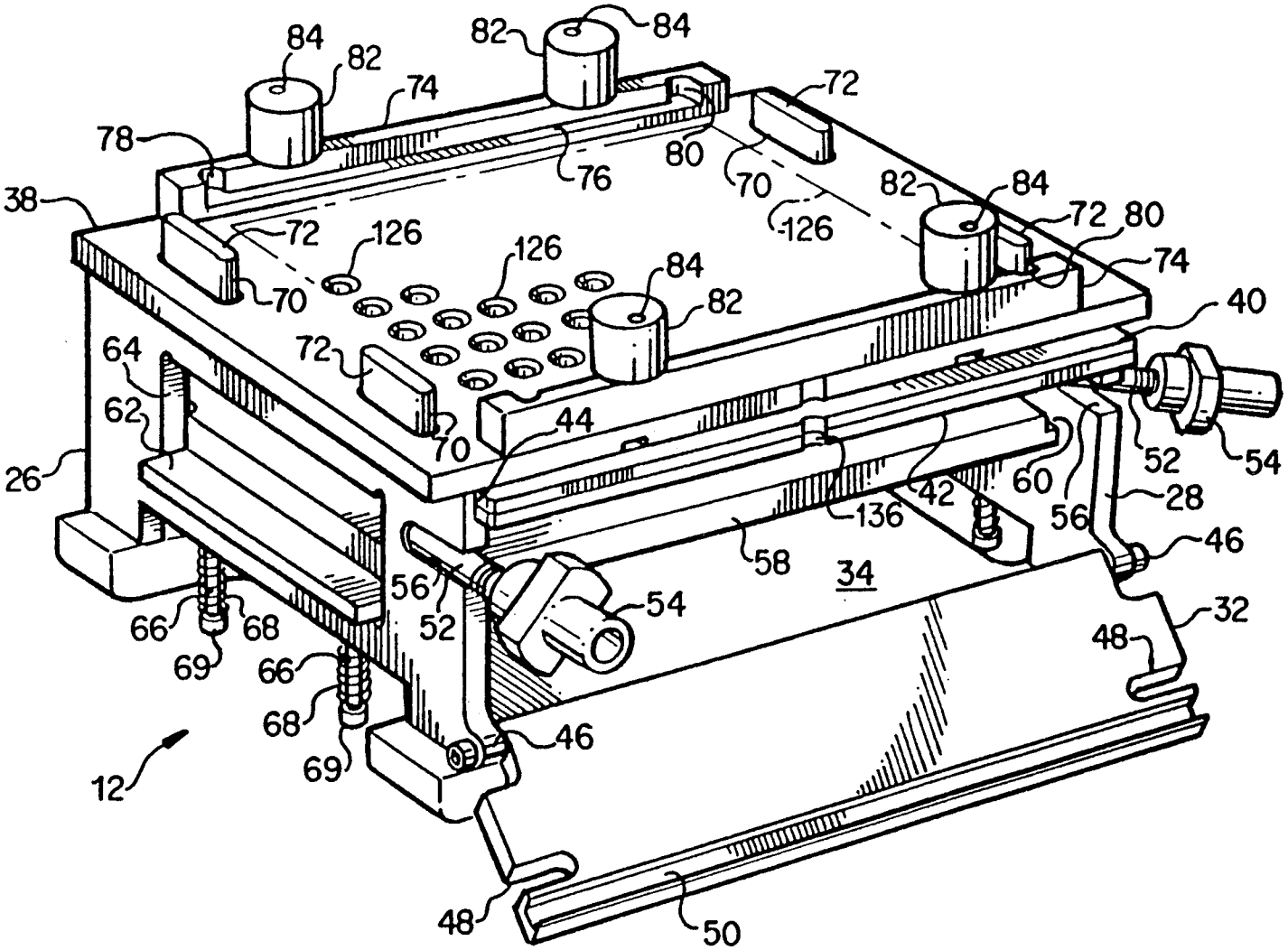
FIG. 2 is a perspective view of the opener/encapsulater component of the system illustrated in FIG. 1.

The door 32 is held in its closed position by connecting means formed of pins 52 (FIG. 2) and threaded knobs 54. The pins 52 fit within recesses 56 cut into the walls 26, 28 and are pivotally connected to the walls 26, 28 so as to be pivotally movable from a closed position to an open position. In FIG. 2, the pin 52 on the left is in its closed position and the pin 52 on the right is in its open position. To hold the door 32 in its closed position, as illustrated in FIG. 4, the knobs 54 are positioned in front of the slots 48 and then tightened (i.e., threaded toward the door 32).

The opener/encapsulater component 12 also has a push plate 58 (FIG. 2) loosely contained within the housing. The push plate 58 is in the shape of a square and is approximately the same size as the capsule receiving plates 40, 42. The front corners 60 (FIG. 4) of the push plate 58 are cut away to make room for the inner distal ends of the pins 52 when the pins 52 are in their open positions.

The push plate 58 has handgrips 62 at opposite sides thereof. The handgrips 62 extend out through opposite openings 64 (FIG. 2) in the walls 26, 28, and thereby are arranged to guide the plate 58 when the plate 58 is lifted vertically from a lower position to an upper capsule-closing position.

The push plate 58 rests upon support pins 66 (FIG. 2) in its lower position. These support pins 66 are threaded through the walls 26, 28 beneath the hole openings 64, so as to selectively determine the height of the push plate 58 in its lower position. Springs 68 press downwardly against the heads 69 of the threaded pins 66 to prevent the pins 66 from being inadvertently moved.

The support plate 38 fits on top of the walls 26, 28 and 30. The support plate 38 has four oblong position-indexing holes 70 which receive corresponding oblong indexing projections 72 extending upwardly from the walls 26, 28. The indexing projections 72 are integrally formed with the walls 26, 28.

Aluminum support slides 74 are fixed to the top of the support plate 38. Each support slide 74 has a ledge 76 which faces inwardly toward the center of the support plate 38. Each ledge 76 has opposite position-limiting ends 78, 80. Connecting knobs 82 are eccentrically pivotally connected to the support slides 74. The knobs 82 are shown in their closed positions in FIGS. 2, 4 and 5. To move the knobs 82 to their open positions, the knobs 82 are rotated 180° about vertical eccentric connecting pins 84. When the knobs 82 are in their open positions, they do not cover any portion of the ledges 76.

A keeper plate 86 (FIG. 1) can be placed over the support plate 38, with edges 88, 90 resting directly on the ledges 76 when the knobs 82 are in their open position. To hold the keeper plate 86 in this position, with the distance between the bottom of the keeper plate 86 and the top of the support plate 38 being equal to the height of the ledges 76, each knob 82 is rotated 180° about its respective pin 84, i.e., from its open position to its closed position.

Figure 6:
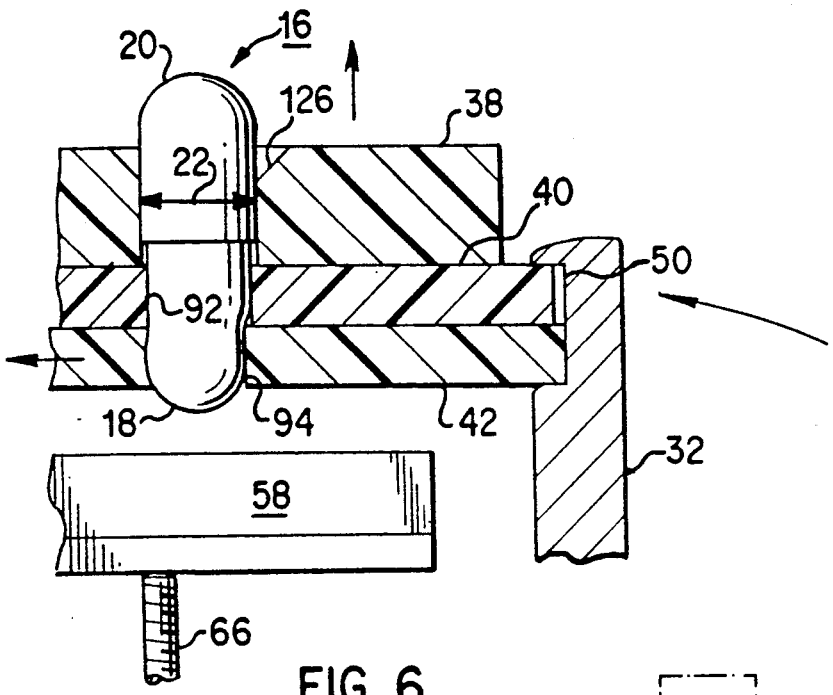
FIG. 6 is a partial cross-sectional view taken along the line 6—6 of FIG. 5.
Figure 7:
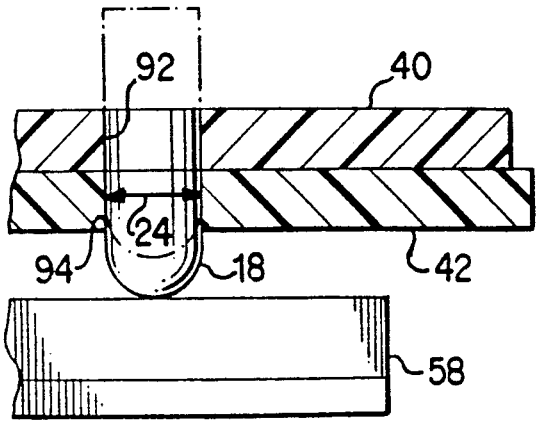
FIG. 7 is a partial cross-sectional view similar to FIG. 6, but with the door in an open position and with the support plate removed.

The capsule receiving plates 40, 42 are shown in more detail in FIG. 4. Each receiver plate 40, 42 has one hundred holes 92, 94, respectively. For each plate 40, 42, the holes 92, 94 are formed in ten columns, with ten holes 92, 94 in each column. The spacings between the holes 92 are identical to the spacings between the holes 94, such that the holes 92, 94 of the two plates 40, 42 can be aligned (FIG. 7). However, the holes 92, 94 are not aligned when the door 32 is closed (FIG. 6). When the door 32 is closed, the bearing means 50 pushes the lower capsule receiving plate 42 toward the back wall 30 (i.e., to the left of FIG. 6). In this door-closed position, the holes 94 are slightly displaced with respect to the holes 92. When the door 32 is opened, the lower plate 42 can be moved outwardly (to the right of FIG. 6), allowing realignment of the holes 92, 94 (FIG. 7).

Figure 11:
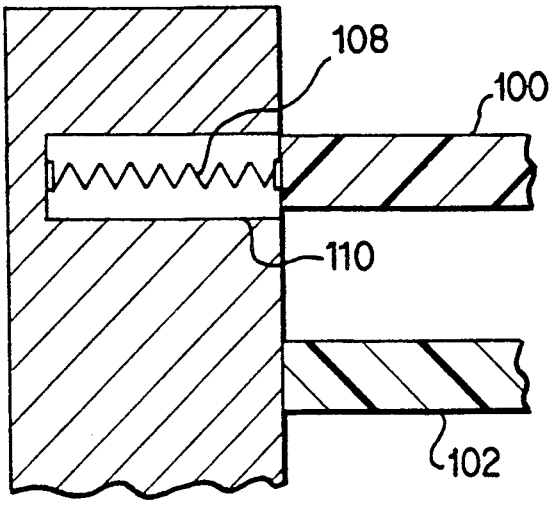
FIG. 11 is a partial cross-sectional view taken along the line 11—11 of FIG. 3.

The loader component 14 (FIG. 3) is formed of a housing with side walls 96, 98, an upper plate 100, a lower plate 102, a base section 104, and a retainer 106 (FIG. 1) for maintaining the plates 100, 102 in the position illustrated in FIG. 1. The top plate 100 is biased toward the retainer 106 by a spring 108 (FIG. 11). The back edge of the top plate 100 can be manually pushed into a recess 110 (i.e., away from the retainer 106) against the compression force of the spring 108.

The top plate 100 has oblong holes 112 (FIG. 3) which are large enough to freely receive the capsules 16 in a horizontal position. There are fifty (five columns, ten holes 112 to a column) of the oblong holes 112 in the top plate 100. The lower plate 102 also has fifty (5×10) holes 114, with the spacings between the holes 114 being the same as the spacings between the holes 112. The distance between each ten-hole column of holes 114 is twice as wide as the distance between each column of holes 92 through the capsule receiving plate 40.

Figure 8:
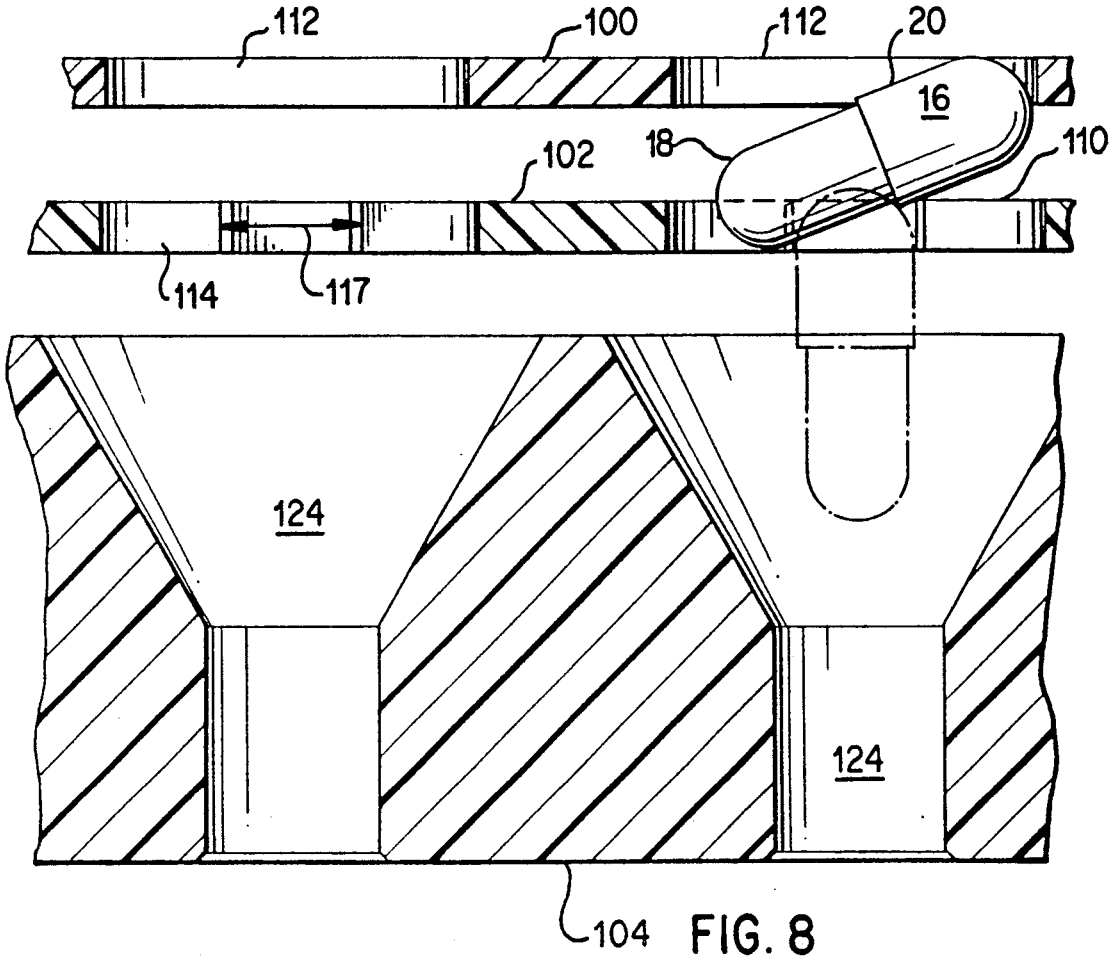
FIG. 8 is a partial cross-sectional view taken along the line 8—8 of FIG. 3.
Figure 12:
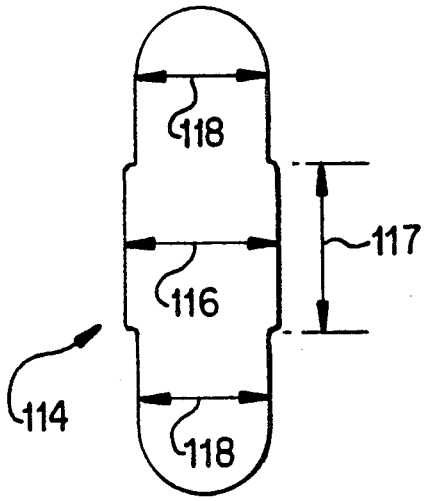
FIG. 12 is a schematic view of a capsule turning hole.

The holes 114 of the bottom plate 102 have a special configuration for turning (or flipping) the capsules 16. In particular, each hole 114 has a midsection width 116 (FIG. 12) which is greater than the widths 118 of its ends. The end widths 118 are slightly smaller than the diameter 22 of the top portion 20 of each capsule 16 and slightly greater than the diameter 24 of the capsule bottom portions 18. The midsection width 116 is greater than the top portion diameter 22. The length 117 of the midsection portion is greater than the diameter 22 of the capsule top portions 20. As a result, the capsules 16 all fall through the holes 114 bottom portions 18 first, as the wider top portions 20 are momentarily hung up on the edges of the holes 114, as illustrated in FIG. 8.

Preferably, the plate 102 is formed of rigid plastic and the holes 114 are formed by machining. This provides a very good flip rate. In the illustrated embodiment, 99–100% of the capsules 16 fall bottom portion 18 first through the holes 114. The Feton machine, in contrast, has a plate with holes that are die cut and stamped out of aluminum. The Feton machine has a 10–40% error rate in flipping capsules.

Figure 3:
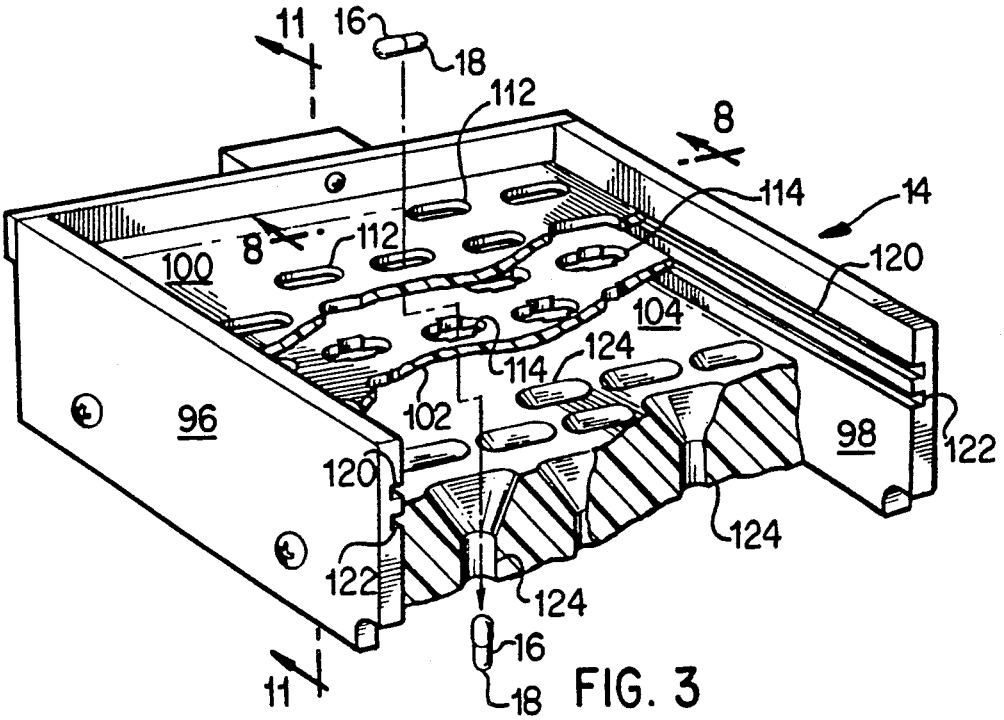
FIG. 3 is a partially cut away perspective view of the loader component of the system illustrated in FIG. 1.

As illustrated in FIG. 3, the plates 100, 102 are slidably received within spaced apart grooves 120, 122. Thus, the plates 100, 102 can be removed from the loader component 14 and replaced with plates that are structurally identical to the plates 100, 102, except that they have holes for different sized capsules. The top groove 120 is coplanar with the recess 110 (FIG. 11), such that the back edge of the plate 100 can be slid into the recess 110.

The base section 104 (FIG. 3) has fifty (5×10) funnels 124 for receiving the capsules 16 as they fall through the holes 114 and for directing the capsules 16 into the holes 126 in the support plate 38. The funnels 124 are located directly underneath the holes 114. The distance between each column of ten funnels 124 is twice as wide as the distance between each column of ten funnel-shaped holes 126.

In operation, the loader component 14 is positioned on the ledges 76 in a first (e.g., left-most position) such that the left-most column of funnels 124 is located directly over the left-most column of holes 126, the next column of funnels 124 is located over the third column of holes 126, the third column of funnels 124 is located over the fifth column of holes 126, etc. In the first position, the left side wall 96 of the loader component 14 is in abutment with the left positioning ends 78 of the support slides 74, and the right side wall 98 is spaced apart from the right position limiting ends 80.

A handful of capsules 16 (more than fifty capsules 16) are then dropped or poured onto the top plate 100. Fifty of these capsules 16 will settle into the oblong holes 112, and any excess capsules 16 (i.e., capsules 16 which do not fit into the holes 112) may be poured off over the front edge 101 of the plate 100. At this point, both of the plates 100, 102 are in abutment with the retainer 106, and the fifty capsules 16 are lying on their sides on top of the bottom plate 102, with the capsules 16 being prevented from moving laterally by the peripheral edges of the holes 112. At this point, the orientation of the fifty capsules 16 is random. Some of the bottom portions 18 may be pointing toward the left of FIG. 3 and the rest of the bottom portions 18 may be pointing to the right of FIG. 3.

The operator then uses his thumbs to push the top plate 100 into the recess 110, against the bias force of the spring 108. When the back edge of the top plate 100 is fully inserted into the recess 110, each hole 112 is over the corresponding hole 114 of the bottom plate 102, such that the capsules 16 fall through the bottom holes 114. As the capsules 16 fall through the specially configured holes 114, the wider top portions 20 are momentarily caught between the edges of the holes 114 until the capsules 16 are moved to the center of the holes 114, such that all of the capsules 16 fall bottom portions 18 first through the plate 102, as illustrated in FIG. 8.

Figure 9:
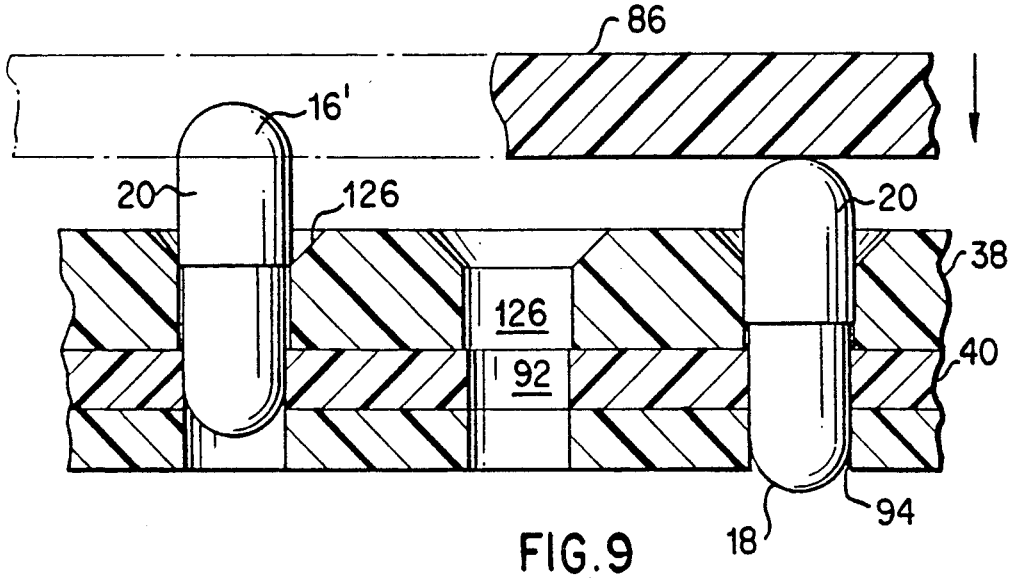
FIG. 9 is a partial cross-sectional view similar to FIG. 6 but showing the use of the keeper plate.

In this way, half of the holes 126 of the support plate 38 receive capsules 16, each bottom portion 18 first. The capsules 16 cannot fall all the way through the funnel-shaped holes 126 because the minimum diameter of each hole 126 is less than the top portion diameter 22 of each capsule 16. In FIG. 9, capsule 16′ is an example of a capsule 16 that has just fallen into a hole 126. Any capsule 16 that inadvertently falls top portion 20 first into a hole 126 can be manually removed and properly reinserted into that hole 126 bottom portion 18 first.

The loader component 14 is then slid over along the ledges 76 to a second position with the right side wall 98 abutting against the right positioning ends 80, and the foregoing procedure is repeated to fill the remaining, alternating fifty holes 126 of the support plate 38. In the second position, the left-most column of funnels 124 is located directly over the second column of holes 126, the next-to-left column of funnels 124 is located over the fourth column of holes 126, the third column of funnels 124 is located over the sixth column of holes 126, etc.

After each of the one hundred holes 126 has received a capsule 16 bottom portion 18 first, the loader component 14 is lifted off of the opener/encapsulater component 12. Then, the keeper plate 86 is positioned above the support plate 38 with the edges 88, 90 resting on the ledges 76. The keeper plate 86 presses the top portions 20 of the capsules 16 down into the funnel-shaped holes 126, as illustrated in FIG. 9. The plate 86 is secured in place by rotating the knobs 82 over the top of the edges 88, 90 of the keeper plate 86.

The door 32 is then rotated upwardly about the hinge 46 to its closed position, and secured in place by rotating the knobs 54 down tight against the front of the door 32, with the pins 52 extending through the slots 48. When the door 32 is tightened in its closed position, the plates 40, 42 are held in place with their holes 92, 94 slightly out of alignment with each other. The bottom portions 18 of the capsules 16 are thereby pinched and held securely within the slightly misaligned holes 92, 94 (FIG. 6).

The support plate 38 with the keeper plate 86 secured thereon is then lifted off the top of the opener/encapsulater component 12. In doing so, the capsule top portions 20 stay between the support plate 38 and the keeper plate 86. This is because the capsule top portions 20 fit snugly within the holes 126.

The door 32 is then opened, allowing the holes 92, 94 to be realigned (FIG. 7). The capsule bottom portions 18 are then gently pushed down (by bouncing the opener/encapsulater component 12 or by means of a spatula (not shown)) until the top edges of the bottom portions 18 are aligned with the top surface of the capsule receiving plate 40, as shown in solid lines in FIG. 7. With the holes 92, 94 in alignment, the bottom portions 18 of the capsules 16 fall all the way down through the system until they reach the top of the push plate 58, which is in its lowermost position. The push plate 58, whose lowermost position is adjusted by the threaded depth adjustment pins 66, prevents the capsule bottom portions 18 from falling or being pushed any farther down through the plates 40, 42. A capsule bottom portion 18 which is ready for filling, with its open top edge even with the top surface of the plate 40 and with its bottom end resting on the push plate 58, is shown in solid lines in FIG. 7.

Figure 13:
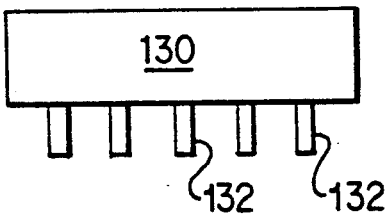
FIG. 13 is a side view of a tamper.

The bottom portions 18 are then filled with medicine or other material. Accurate filling is possible since the top edge of each capsule bottom portion 18 is located at the top surface of the plate 40. A tamper 130 (FIG. 13) with individual tamper projections 132 may be used for this procedure. Preferably, the spacings between the projections 132 are the same as the spacings between the holes 92. The tamper 130 has five projections 132 in a single row. In an alternative embodiment, the tamper may have five columns of five projections each, so as to tamp material into twenty five capsule bottom portions 18 at a time. A spatula (not illustrated) may also be used.

After all of the bottom portions 18 of the capsules 16 have been filled, the top portions 20 are returned by placing the support plate 38 back on top of the opener/encapsulater component 12 (i.e., the holes 70 are placed back over the projections 72). The operator then grabs the handgrips 62 and the support plate 38 and squeezes, causing the push plate 58 to move upwardly, such that the capsule bottom portions 18 are pressed back and locked by friction into the respective top portions 20. During this procedure, upward movement of the top portions 20 is resisted by the keeper plate 86. The support plate 38 can then be removed, the knobs 82 can be rotated to disassemble the keeper plate 86 from the plate 38, and the now filled and re-connected capsules 16 can then be pushed upwardly out through the holes 126 in the support plate 38, which completes the filling procedure.

An important feature of the present invention is that the capsule receiving plates 40, 42, the loader plates 100, 102, and the support plate 38 can all be removed and replaced by plates with identical structures except for different sized holes. The plates 40, 42 can be slid out of the housing after opening the door 32. New plates for different sized capsules can then be slid onto the ledges 44 and the position of the push plate 58 can be adjusted for the new size capsules. Preferably, the top surface of the push plate 58 would be set at a distance from the top surface of the capsule receiving plate 40 equal to the length of the bottom portions 18 of the new capsules. The depth adjustment screws 66 may have markings (not shown) such that the push plate 58 can be rapidly adjusted to predetermined positions for handling the different sized capsules.

To remove and replace the plates 100, 102, the retainer 106 (FIG. 1) is slid downwardly until pins 132 are in engagement with the tops of slots 134. The plates 100, 102 can then be slid out of the grooves 120, 122 and replaced by similarly structured plates with different sized holes. The support plate 38 can also be lifted off of the housing and replaced by a similarly structured support plate with funnel-shaped holes sized for the new capsules.

Figure 14:
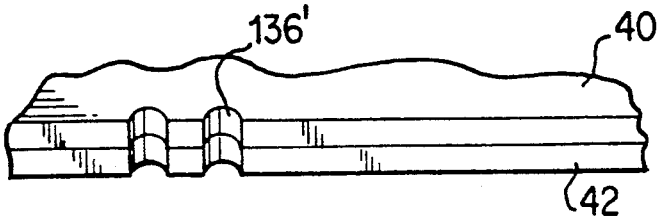
FIG. 14 is a partial perspective view showing means for identifying plates.

The plates 40, 42, 38, 100, 102 are all keyed to each other by visual indicia. In the example illustrated in the drawings, each plate 40, 42, 38, 100, 102 has a single notch 136, indicating that the plates 40, 42, 38, 100, 102 are designed for the largest capsules handled by the system. Plates for the next smaller size of capsules may have two notches 136' (FIG. 14), and plates for the next smaller size of capsules may have three notches, etc. A preferred keying system is as follows: 1 slot, size #3; 2 slots, size #1; 3 slots, size #0; 4 slots, size #00.

Also, the plates 40, 42 and 100, 102 are preferably color coded. In the illustrated embodiment, the plate 40 is formed of a gray tinted translucent plastic, and the plate 42 is formed of an opaque white plastic, the plate 100 is formed of black plastic, and the plate 102 is formed of opaque white plastic. This color coding scheme makes it easy to distinguish one plate from another.

Another important feature of the invention is that the plates 40, 42, 38, 100, 102 are accurately machined so as to be interchangeable with the plates 40, 42, 38, 100, 102 of another capsule handling system 10. By making the plates 40, 42, 38, 100, 102 interchangeable between different machines, it is possible for a pharmacist to take n number of distinct capsules and make $n^2$ new and distinct capsules from them by interchanging their top and bottom portions.

To interchange top and bottom capsule portions 20, 18, a loader component 14 is used to position and orient a first set of one hundred capsules 16 within a first opener/encapsulater component 12. Then, a second set of one hundred capsules 16 are positioned and oriented within a second opener/encapsulater component 12. The same loader component 14 may be used to load both opener/encapsulater components 12. Then, the top portions 20 of the two hundred capsules 16 are separated from their bottom portions 18, and the one hundred bottom portions 18 of the first set of capsules 16 are filled with medicine.

Then, the top portions 20 of the second set of capsules 16 are fitted onto the filled bottom portions 18 of the first capsule set. This is done by placing the support plate 38 of the second opener/encapsulater component 12 over the capsule receiving plate 40 of the first component 12, and squeezing the handgrips 62 of the first component 12 toward the support plate 38 of the second component 12. If the top and bottom portions of the first set of empty capsules are both red, and the top and bottom portions of the second set of empty capsules are both black, then the above-described procedure would produce one hundred red and black capsules.

Being able to interchange capsule portions with the present invention produces great cost savings. A pharmacist wanting to produce one hundred distinct types of capsules would only have to purchase ten types of empty capsules from a capsule manufacturer, and capsule manufacturers generally sell empty capsules in lots of at least one million capsules.

The above description and drawings are only illustrative of preferred embodiments which achieve the objects, features and advantages of the present invention, and it is not intended that the present invention should be limited thereto. Any modifications of the preferred embodiments which come within the spirit and scope of the following claims is to be considered part of the present invention.

What is claimed as new and desired to be protected by Letters Patent of the United States is:

1. A method of handling capsules, said method comprising the steps of:

providing a loader component and an opener/encapsulater component;

providing first capsules and second capsules, wherein said second capsules are larger than said first capsules;

providing two first capsule receiving plates for holding said first capsules within said opener/encapsulater component, and providing two second capsule receiving plates for holding said second capsules within said opener/encapsulater component;

sliding said first capsule receiving plates into said opener/encapsulater component, such that said first capsule receiving plates are located within substantially horizontal planes within said opener-/encapsulater component;

subsequently, simultaneously transferring said first capsules from said loader component to said opener/encapsulater component and orienting said first capsules within said first capsule receiving plates;

sliding said first capsule receiving plates relative to one another within said substantially horizontal planes in order to grip bottom portions of said first capsules;

subsequently, removing said first capsule receiving plates from said opener/encapsulater component by sliding both of said first capsule receiving plates out of said opener/encapsulater component, said first capsule receiving plates remaining substantially within said horizontal planes during said removing step;

subsequently, sliding both of said second capsule receiving plates into said opener/encapsulater component, said second capsule receiving plates being located substantially within said horizontal planes during said step of sliding said second capsule receiving plates into said opener/encapsulater component;

subsequently, simultaneously transferring said second capsule from said loader component to said opener-/encapsulater component and orienting said second capsules within said second capsule receiving plates; and sliding said second capsule receiving plates relative to one another within said substantially horizontal planes in order to grip bottom portions of said second capsules.

2. The method of claim 1, wherein said first and second capsules include gelatin capsules.

3. A capsule handling system, comprising:

an opener/encapsulater component for opening, filling and closing capsules; and a loader component for positioning and orienting the capsules within said opener/encapsulater component;

wherein said opener/encapsulater component includes first and second capsule receiving plates, said first plate having a plurality of holes for receiving the capsules, said second plate having a plurality of holes for receiving the capsules, said second plate being displaceable with respect to said first plate to hold bottom portions of the capsules within said holes of said first and second plates, both of said first and second plates being removable from said opener/encapsulater component and replaceable with plates having different sized holes, whereby said opener/encapsulater component is capable of handling different sized capsules;

wherein said opener/encapsulater component includes a housing with means for slidably receiving said first and second plates, said housing including a door for slidably displacing said second plate with respect to said first plate; and wherein said housing includes a substantially horizontal ledge for slidably supporting said first and second capsule receiving plates, such that said first and second capsule receiving plates are both slidably removable from said housing in a substantially horizontal direction.

4. The system of claim 3, further comprising a tamper for tamping material into bottom portions of the capsules.

5. The system of claim 3, wherein said housing has a main section, and wherein said door has a lower portion and an upper portion, said lower portion of said door being connected to said main section of said housing by a hinge, said door being rotatable about said hinge between an open position and a closed position, said upper portion of said door being arranged to bear against said second plate to displace said second plate with respect to said first plate when said door is moved to its closed position.

6. The system of claim 5, wherein said housing includes a holding arm for holding said door in its closed position, said holding arm being pivotally connected to said main section of said housing.

7. The system of claim 3, wherein said opener/encapsulater component includes a push plate for pushing bottom portions of the capsules upwardly through said first and second capsule receiving plates.

8. The system of claim 7, wherein said opener/encapsulater component includes means for adjustably positioning said push plate.

9. The system of claim 3, wherein said opener/encapsulater component further includes a support plate component for positioning said loader component above said housing and for withdrawing top portions of the capsules from bottom portions of the capsules when the bottom portions of the capsules are held within said holes of said first and second capsules receiving plates.

10. The system of claim 9, wherein said support plate component includes a support plate with holes for receiving the capsules from said loader component, said support plate component including a keeper plate for maintaining top portions of the capsules within said holes of said support plate, and wherein said support plate component includes means for releasably connecting said keeper plate to said support plate.

11. The system of claim 10, wherein said loader component includes funnels for directing the capsules toward said opener/encapsulater component, and wherein said support plate component includes support means for slidably supporting said loader component in first and second positions, wherein said funnels are located above a first portion of said holes of said support plate when said loader component is in its first position, and wherein said funnels are located above a second portion of said holes of said support plate when said loader component is in its second position.

12. The system of claim 11, wherein said supporting means is arranged to releasably support said keeper plate.

13. The system of claim 9, wherein said loader component includes first and second loader plates, said first loader plate having generally oblong holes for receiving the capsules and for positioning the capsules on top of said second loader plate, said second loader plate having holes for turning and thereby orienting the capsules, and wherein said loader component includes means for displacing one of said first and second loader plates with respect to the other such that said holes of said first loader plate are located above said holes of said second loader plate, whereby the capsules fall through said second loader plate, with the bottom portions of the capsules falling through said holes of said second loader plate before top portions of the capsules fall through said holes of said second loader plate.

14. The system of claim 13, wherein said loader component includes grooves for slidably receiving said first and second loader plates.

15. The system of claim 14, wherein said loader component includes means for releasably holding said loader plates within said grooves.

16. The system of claim 15, wherein said holding means comprises a slidable retainer plate.

17. The system of claim 15, wherein said loader component includes a spring for biasing said first loader plate against said holding means.

* * * * *